US006059550A

United States Patent [19]

Rha

[11] Patent Number: 6,059,550

[45] Date of Patent: May 9, 2000

[54] TWIN-CYLINDER IMPELLER PUMP

[76] Inventor: Phil Chan Rha, 3-404 Daewoo Mokhwa Apartment, 31-1, Seongjeong-dong, Chunan-shi, Choongchungnam-do 330-170, Rep. of Korea

[21] Appl. No.: 09/101,397

[22] PCT Filed: Nov. 7, 1997

[86] PCT No.: PCT/KR97/00218

§ 371 Date: Jul. 9, 1998

§ 102(e) Date: Jul. 9, 1998

[87] PCT Pub. No.: WO98/21478

PCT Pub. Date: May 22, 1998

[30] Foreign Application Priority Data

Nov. 11, 1996 [KR] Rep. of Korea ..... 96/53208

[51] Int. Cl.[7] ..... F01C 1/02

[52] U.S. Cl. ..... 418/58; 418/112; 418/142

[58] Field of Search ..... 418/58, 112, 142

[56] References Cited

U.S. PATENT DOCUMENTS

| | | | |
|---|---|---|---|
| 21,632 | 9/1858 | Trimmer | 418/58 |
| 1,041,606 | 10/1912 | Dembowsky | 418/58 |
| 5,704,774 | 1/1998 | Rha | 418/58 |

FOREIGN PATENT DOCUMENTS

| | | | |
|---|---|---|---|
| 455024 | 7/1913 | France | 418/58 |
| 1403089 | 5/1965 | France | 418/58 |
| 2541368 | 8/1984 | France | 418/58 |
| 3343796 | 7/1985 | Germany | 418/58 |
| 58-152189 | 9/1983 | Japan | 418/58 |

*Primary Examiner*—Thomas Denion
*Assistant Examiner*—Thai-Ba Trieu
*Attorney, Agent, or Firm*—Watson Cole Grindle Watson, P.L.L.C.

[57] ABSTRACT

A twin-cylinder impeller pump is disclosed. In the above pump, the twin-cylinder runner (3, 4) is provided with an elastic sealing means for removing any gap from the junction between the runner and the throat of a pump casing (10) with the runner being positioned at its upper or lower dead point. In a transmission gear mechanism of the above pump, the drive shaft does not directly engage with the driven shaft, but indirectly engages with the driven shaft through two idle gears (14, 17). In each of the idle gears (14, 17), both a circular concentric gear (14, 17) and an elliptical eccentric gear (15, 18) are commonly mounted to a shaft, thus forming a twin gear. The two elliptical eccentric gears (15, 18) engage with each other, while the two circular concentric gears (14, 17) engage with the drive and driven gears (13, 16) respectively, thus effectively reducing operational noises and vibrations during a pumping operation.

5 Claims, 7 Drawing Sheets

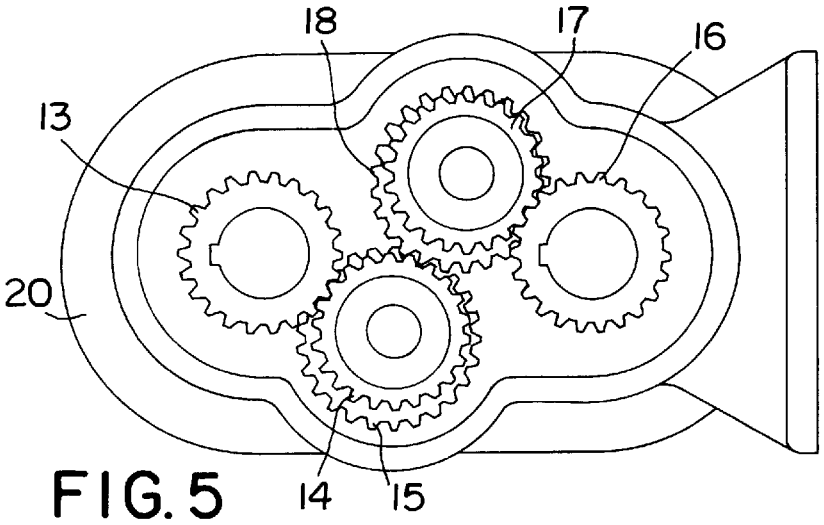
FIG. 5
FIG. 6A
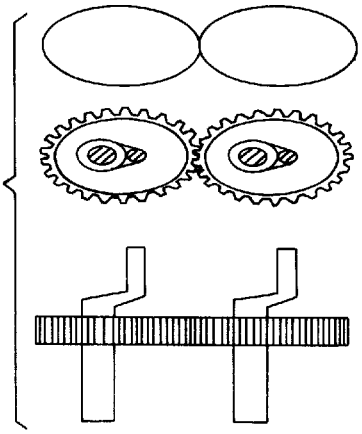
FIG. 6B
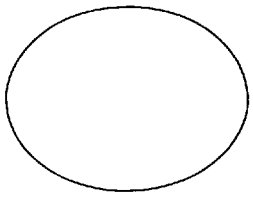
FIG. 6C
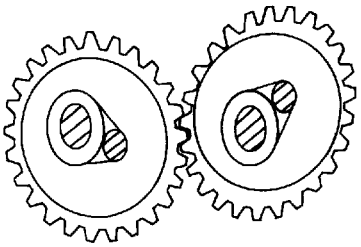

TWIN-CYLINDER IMPELLER PUMP

TECHNICAL FIELD

The present invention relates, in general, to impeller pumps used for providing continuous power to move liquids and, more particularly, to a twin-cylinder impeller pump with a twin cylinder runner capable of completely sealing the junction between the twin cylinder runner and the intermediate throat of a pump casing with the twin cylinder runner being positioned at its upper or lower dead point, thus effectively sucking and discharging pressurized liquid relative to the pump casing, the impeller pump also having an improved transmission gear mechanism suitable for reducing operational noises and vibrations during a pumping operation.

BACKGROUND ART

Several types of impeller pumps, used for providing continuous power to move liquids, are known to those skilled in the art. In the typical impeller pumps, a blade, gear, screw or cam-type impeller or runner is rotatably arranged in a pump casing, thus being capable of forcibly moving liquids, such as oil or water, under pressure. However, the known impeller pumps are problematic in that the moving distance of a runner is too long to conserve power during every pumping cycle. In addition, the runner of a known impeller pump also comes into contact with violent vortex or turbulent flow of liquid at an exceedingly large contact area during a pumping operation, thus overly consuming power. Such a contact between the runner and the violent vortex or turbulent flow of liquid also generates frictional heat and consumes the runner due to frictional abrasion, thereby preventing the pump from being operated at a high speed and reducing the expected life span of the pump.

Another problem experienced in each of the above impeller pumps is that both a runner and a runner chamber of a pump casing have a complex construction, thus being limited in their design flexibility and use.

Korean Patent Publication No. 91-4769 and Japanese Patent Appln. No. Sho. 63-126511 individually disclose a rotary compressor. In each of the above rotary compressors, one cylindrical rotor or runner is eccentrically arranged in the rotor chamber of a compressor casing and is eccentrically rotated in the chamber, thus compressing liquids prior to moving the liquids. However, the moving distance of the above rotor is too long to effectively accomplish desired operational efficiency of the compressor during an operation. In addition, the above rotary compressors individually require a plurality of spring-biased thin blades and a check valve, with the check valve being used for preventing unexpected reverse flow of liquids from a discharge port during a suction stroke of the rotor. Therefore, the rotary compressors have a complex construction with a plurality of delicate and vulnerable points, which prevent the compressors from being operated at a high speed and high pressure and reduce the expected life span of the compressors.

Korean Patent Publication No. 90-3682 and Japanese U.M. Appln. No. Sho. 61-178289 individually disclose a vane pump with a plurality of spring-biased thin blades. However, each of the above vane pumps has the same problems as that described for the above rotary compressors due to the thin blades.

Korean Patent Publication No. 89-628 and Japanese Patent Appln. No. Sho. 59-222753 individually disclose a scroll-type hydraulic machine. Each of the above hydraulic machines has a complex scroll structure, which includes a plurality of specifically designed involute and arcuate curves. However, such a complex scroll structure makes the production of the hydraulic machines very difficult and increases the manufacturing cost of the machines. In the operation of the above hydraulic machines, pressurized liquid is sucked into and discharged from a machine through variable liquid chambers, which are formed by the movable and stationary scrolls and individually have a small area. Therefore, the hydraulic machines regrettably limit the amount of sucked and discharged liquid during one rotation of the movable scroll relative to the stationary scroll.

In an effort to effectively overcome the above problems, the inventor of this invention proposed a twin-cylinder impeller pump with a twin cylinder runner in Korean Patent Appln. No. 94-10299. The above impeller pump has a simple and effective construction, thus being easily produced and having improved pump efficiency and being effectively used for various applications. FIGS. 1 and 2 show the construction of the above impeller pump. As shown in the drawings, the twin cylinder runner is comprised of two cylinder impellers, that is, first and second cylinder impellers 103 and 104 integrated into a single structure by a web. The two cylinder impellers 103 and 104, having the same size and configuration, are eccentrically fitted over two shafts 112 and 113 with bearings and are rotatable around the shafts 112 and 113 in opposite directions while maintaining the same eccentricity. The two shafts 112 and 113 are eccentrically connected to two eccentric transmission gears 116 and 117, which have the same size and eccentricity and engage with each other. When the twin cylinder runner is moved in a pump casing with the two cylinder impellers 103 and 104 being eccentrically rotated around the shafts 112 and 113, the interval between the center of each cylinder impeller 103, 104 and the center of an associated shaft 112, 113 is almost completely maintained. The two cylinder impellers 103 and 104 are eccentrically received in two cylindrical chambers 105 and 106 of the pump casing, thus being slidably inscribed with the chambers 105 and 106 respectively. The two chambers 105 and 106, having the same size and configuration, are symmetrically formed in the casing with an intermediate throat being formed between the two chambers 105 and 106 and communicate with each other through an opening formed at the intermediate throat of the casing. A suction port 107 is formed at one side wall of the throat of the casing, while a discharge port 108 is formed at the other side wall of the throat at a position opposite to the suction port 107. The two cylinder impellers 103 and 104 are integrated with each other into a single structure by a web. The web of the twin cylinder runner is also used as a partition wall since the web isolates the two ports 107 and 108 from each other.

In the above twin-cylinder impeller pump, the two cylinder impellers 103 and 104 and the chambers 105 and 106 individually have a genuine cylindrical configuration. In addition, the above impeller pump is also free from any delicate moving points except for the two cylinder impellers 103 and 104 integrated into a single structure by the web. Therefore, the above pump has a simple construction suitable for being easily produced and being effectively used for a lengthy period of time without breaking down. The two cylinder impellers 103 and 104, having a genuine cylindrical configuration, smoothly slide on the internal surfaces of the chambers 105 and 106 while alternately sucking and discharging pressurized liquid relative to the chambers 105 and 106, thus being almost free from the formation of any pulsation. The above impeller pump reduces the moving distance of the runner and remarkably reduces the contact area between the runner and the pressurized liquid, and causes neither violent vortex nor turbulent flow of liquid, thus conserving power and being somewhat effectively operated at a high speed and high pressure.

However, the above twin-cylinder impeller pump is problematic in that when the twin cylinder runner is positioned at its upper or lower dead point, a gap is formed between one of the two cylinder impellers 103 and 104 and the side wall of an associated chamber 105, 106 at a position "S" around the throat of the pump casing as shown in FIG. 2. The above gap allows pressurized liquid to pass through during a pumping operation, thus causing a pressure loss of the pump. Another problem of the above impeller pump is caused by the eccentric transmission gears 116 and 117. That is, the two shafts 112 and 113 are eccentrically connected to the gears 116 and 117 as described above and so the shafts 112 and 113 may reduce operational efficiency of the pump. In addition, when the twin cylinder runner is positioned outside the upper or lower dead point, the interval between the two shafts 112 and 113 becomes longer and may cause an operational problem of the pump. The above impeller pump is thus designed to maintain a contact interval between the two shafts 112 and 113 irrespective of positions of the twin cylinder runner in the pump casing. That is, the two shafts 112 and 113 are eccentrically connected to the eccentric gears 116 and 117, respectively. However, such eccentric gears have different angular velocities and so they may engage with each other with excessive interference at their mating portions perpendicular to the eccentric direction. In such a case, the two gears are excessively interfered with each other and fail to be smoothly operated. In order to overcome such an interference between the two eccentric gears, the two gears 116 and 117 of the above impeller pump are provided with a large backlash between them. However, such a large backlash causes operational noises and vibrations of the gears 116 and 117.

DISCLOSURE OF THE INVENTION

Accordingly, the present invention has been made keeping in mind the above problems occurring in the prior art, and an object of the present invention is to provide an impeller pump, which is provided with a twin cylinder runner capable of almost completely removing any gap from the junction between the runner and the intermediate throat of a pump casing with the runner being positioned at its upper or lower dead point, thus effectively sucking and discharging pressurized liquid relative to the pump casing, and of which the eccentric transmission gear mechanism is smoothly operated without having any excessive backlash between eccentric gears, thus effectively reducing operational noises and vibrations during a pumping operation.

In order to accomplish the above object, the present invention provides a twin-cylinder impeller pump, comprising: a pump casing having two cylindrical chambers and suction and discharge ports, the chambers being symmetrically formed in the casing, with an intermediate throat being formed between the two chambers, and also communicating with each other through an opening formed at the throat, and the suction and discharge ports being formed at opposite side walls of the throat; a twin cylinder runner movably received in the pump casing and comprised of two cylinder impellers integrated into a single structure by a web, the two cylinder impellers being eccentrically received in the two chambers of the casing with the web passing through the opening of the throat of the casing, thus being slidably inscribed with the chambers respectively; and a gear mechanism adapted for transmitting a rotating force to the twin cylinder runner, thus allowing the two impellers of the runner to move in the chambers in opposite directions, the gear mechanism comprising: drive and driven circular gears arranged to be spaced apart from each other and fixedly and concentrically fitted over eccentric shafts respectively, each of the eccentric shafts having an eccentric part at one end thereof and being rotatably connected to each of the two cylinder impellers at the eccentric part; and two idle gears arranged between the drive and driven gears, thus allowing the drive and driven gears to be rotated in opposite directions, each of the idle gears being comprised of a circular concentric gear and an elliptical eccentric gear commonly connected to one shaft and integrated into a twin gear, the two concentric gears engaging with the drive and driven gears respectively and the two eccentric gears engaging with each other, thus transmitting the rotating force of the drive gear to the driven gear and allowing the drive and driven gears to be rotated in opposite directions, each of the elliptical eccentric gears having a major axis in an eccentric direction and a minor axis in another direction perpendicular to the eccentric direction, The twin cylinder runner is provided with an elastic sealing means for removing any gap from the junction between the runner and the throat of the pump casing with the runner being positioned at its upper or lower dead point.

The width of each of the suction and discharge ports is smaller than the maximum gap between the outer surface of each of the cylinder impellers and the inner surface of an associated chamber.

BRIEF DESCRIPTION OF THE DRAWINGS

The above and other objects, features and other advantages of the present invention will be more clearly understood from the following detailed description taken in conjunction with the accompanying drawings, in which:

FIG. 5 is a view of a transmission gear mechanism included in the impeller pump of this invention;

FIGS. 6A to 6C are views respectively illustrating the operational theory of elliptical eccentric gears used in this invention;

BEST MODE FOR CARRYING OUT THE INVENTION

Figure 3:
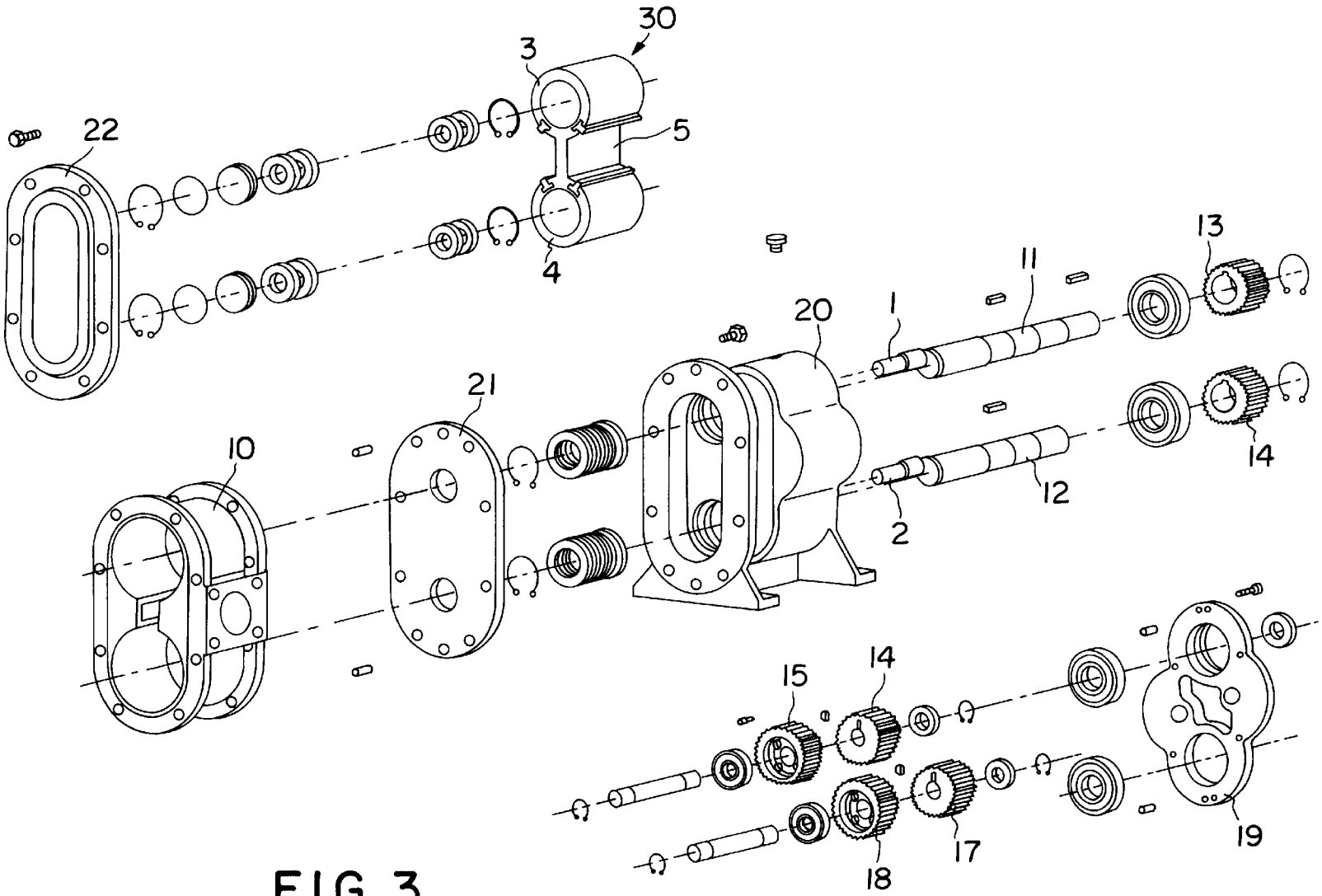
FIG. 3 is an exploded perspective view showing the construction of a twin-cylinder impeller pump in accordance with the present invention.
Figure 4:
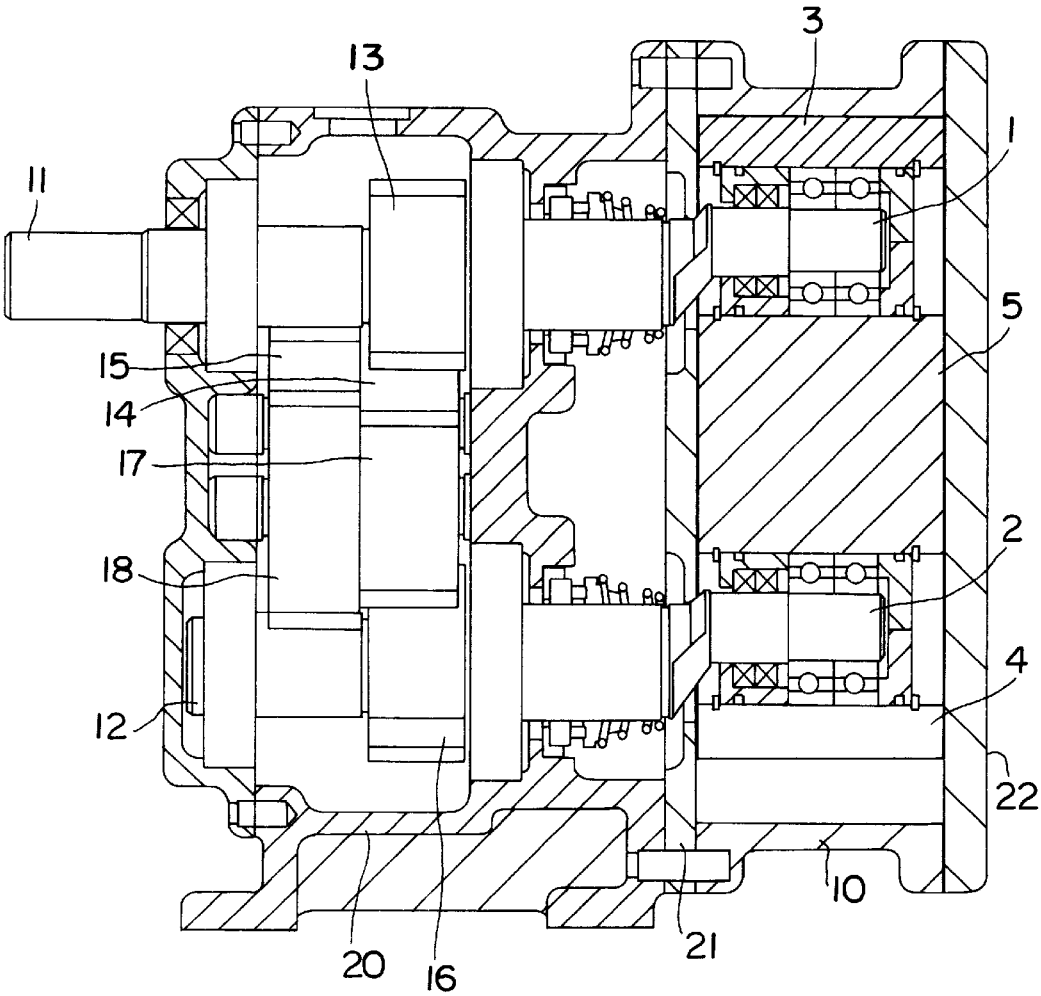
FIG. 4 is a sectional view of the impeller pump of this invention.

FIGS. 3 and 4 show the construction of a twin-cylinder impeller pump with a twin cylinder runner in accordance with the present invention.

As shown in the drawings, the twin cylinder runner of this invention is movably received in a pump casing 10 and is comprised of two cylinder impellers, that is, first and second cylinder impellers 3 and 4 which have a genuine cylindrical configuration and are integrated into a single structure by a web 5. The two cylinder impellers 3 and 4 are eccentrically received in two cylindrical chambers 8 and 9 of the pump casing 10, thus being slidably inscribed with the chambers 8 and 9 respectively. The two chambers 8 and 9 are symmetrically formed in the casing 10 with an intermediate throat being formed between the two chambers 8 and 9 and communicate with each other through an opening 5' formed at the intermediate throat of the casing 10. A suction port 6 is formed at one side wall of the throat of the casing 10, while a discharge port 7 is formed at the other side wall of the throat at a position opposite to the suction port 6. The width of each of the two ports 6 and 7 is smaller than the maximum gap between the outer surface of each cylinder impeller 3, 4 and the inner surface of an associated chamber 8, 9.

When the twin cylinder runner is received in the pump casing 10 with the two cylinder impellers 3 and 4 being positioned in the two chambers 8 and 9, the web 5 passes through the opening 5', thus effectively isolating the two ports 6 and 7 from each other.

The twin-cylinder impeller pump of this invention also has a transmission gear mechanism, which transmits the rotating force of a motor to the twin cylinder runner, thus allowing the runner to move in the pump casing 10. In the gear mechanism, a genuine circular drive gear 13 is fixed to one end of a motor-operated drive shaft 11, while a genuine circular driven gear 16 is fixed to one end of a driven shaft 12. The two shafts 11 and 12 are arranged parallel to each other, with the two gears 13 and 16 being brought into engagement with each other. An eccentric shaft 1, 2 is eccentrically fixed to the other end of each of the shafts 11 and 12 and is rotatably fitted into an associated cylinder impeller 3, 4 of the twin cylinder runner.

The two gears 13 and 16 cooperate with each other through two idle gears. Each of the two idle gears is comprised of a circular concentric gear 14, 17 and an elliptical eccentric gear 15, 18, which are commonly connected to one shaft, thus being integrated into a twin gear. The two eccentric gears 15 and 18 have the same eccentricity in the same direction and individually have a major axis in an eccentric direction and a minor axis in another direction perpendicular to the eccentric direction. The two eccentric gears 15 and 18 engage with each other.

That is, the drive gear 13 engages with the circular concentric gear 14 of the first idle gear, while the driven gear 16 engages with the circular concentric gear 17 of the second idle gear. The engagement between the above drive, driven and idle gears is best seen in FIG. 5.

In the operation of the above gear mechanism, the rotating force of the motor-operated drive gear 13 is transmitted to the driven gear 16 through the two idle gears. Therefore, the drive and driven gears 13 and 16 are rotated in opposite directions.

In such a case, the two elliptical eccentric gears 15 and 18 engage with each other, thus effectively transmitting the rotating force of the drive gear 13 to the driven gear 16 while maintaining a constant interval between the two eccentric shafts 1 and 2 regardless of different angular velocities of the two eccentric gears 15 and 18.

Figure 1:
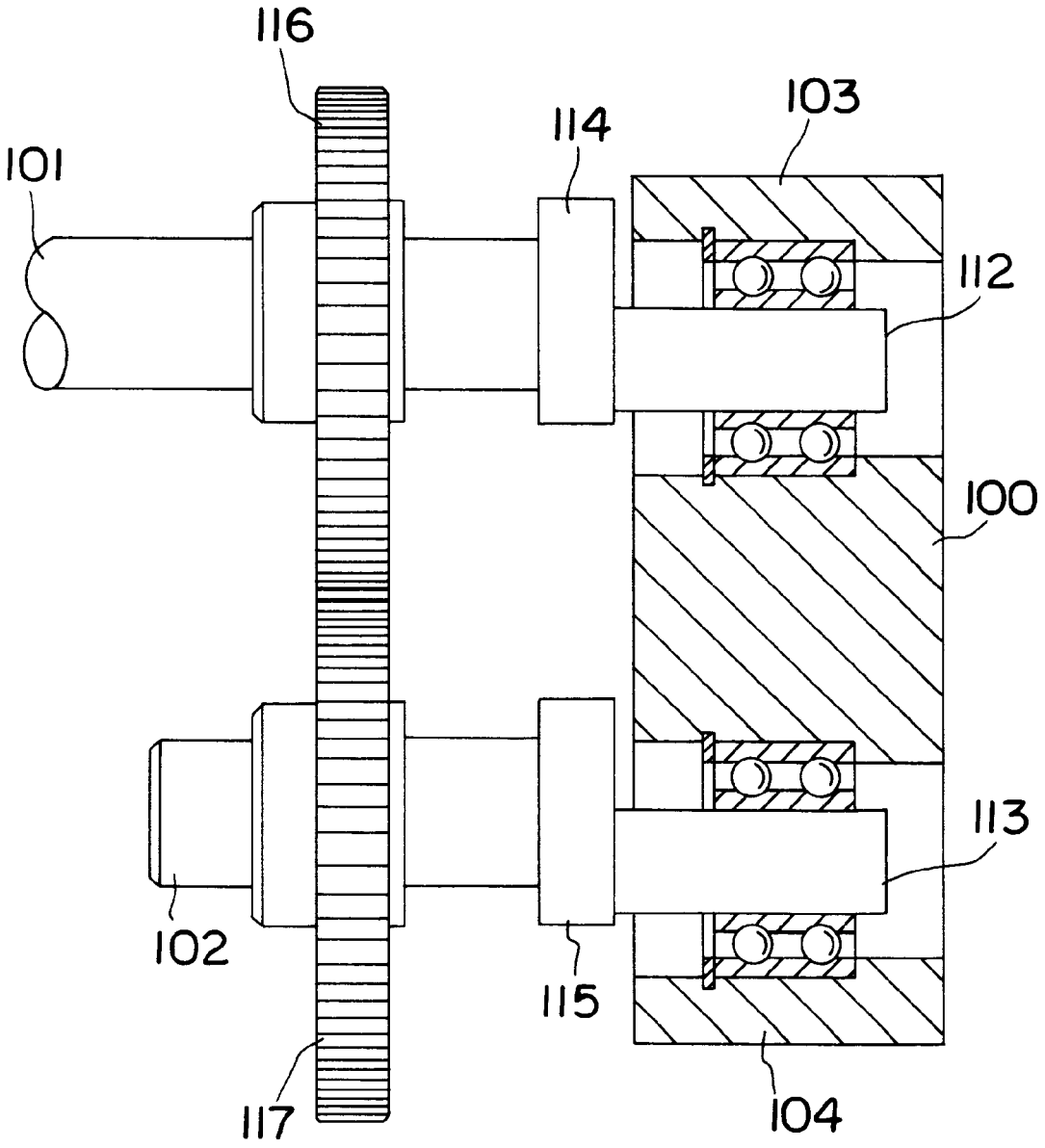
FIG. 1 PRIOR ART
FIG. 1 is a sectional view showing the construction of a typical twin-cylinder impeller pump.
Figure 2:
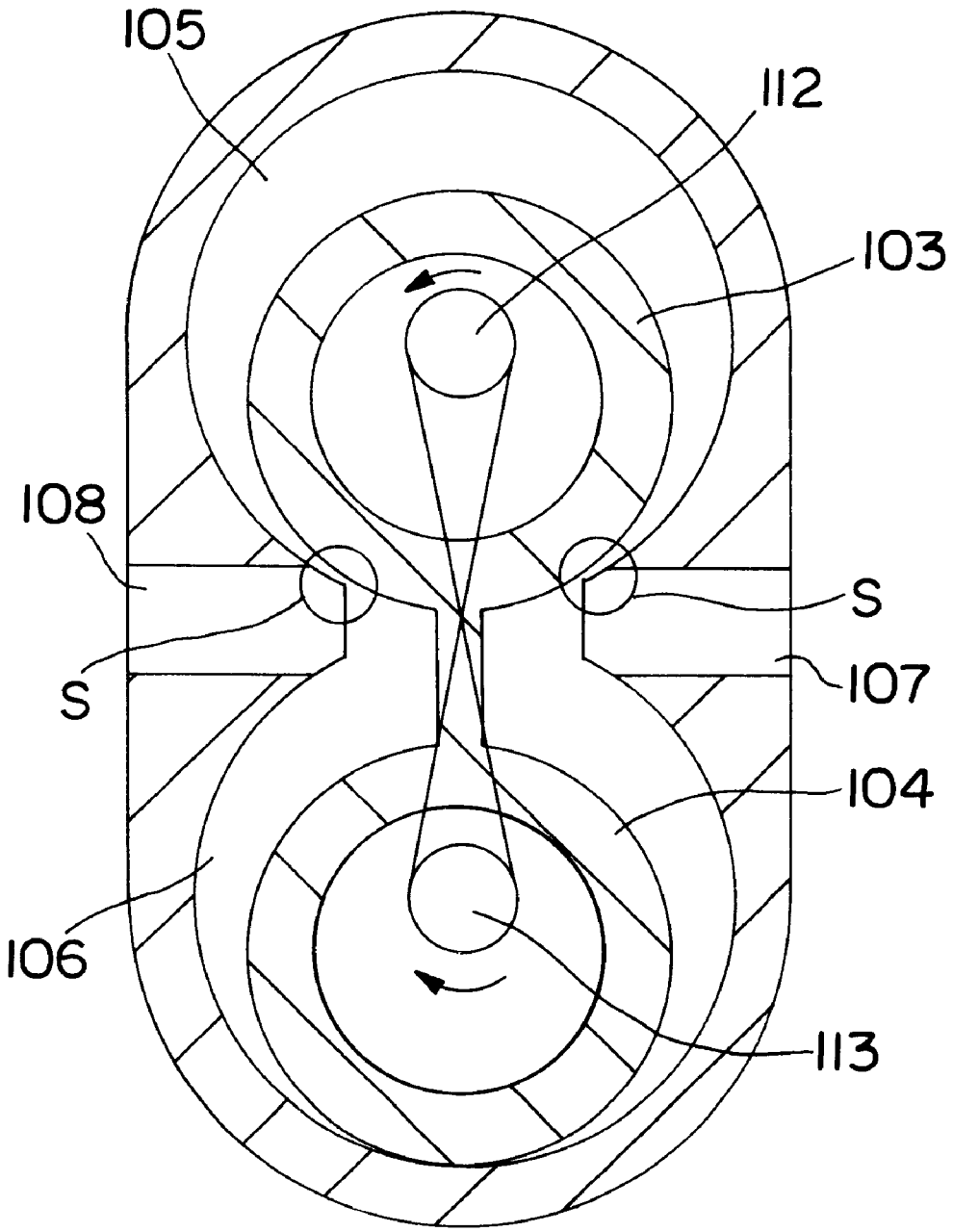
FIG. 2 PRIOR ART
FIG. 2 is a sectional view showing a twin cylinder runner of the above pump when the runner positioned at its lower dead point in a pump casing.

Therefore, the two elliptical eccentric gears 15 and 18 are free from any excessive backlash different from the transmission gear mechanism of the typical twin-cylinder impeller pump of FIGS. 1 and 2. The transmission gear mechanism of this invention thus effectively reduces operational noises and vibrations during a pumping operation.

Since the drive gear 13 cooperates with the driven gear 16 through the two idle gears, it is possible to use small-sized gears as the drive and driven gears 13 and 16, thus conserving power and improving operational efficiency of the pump.

The operational theory of elliptical eccentric gears used in this invention will be described in detail with reference to FIGS. 6A to 6C.

FIGS. 6A to 6C show two elliptical eccentric gears G1 and G2, which engage with each other, with S1, S2: two eccentric shafts, C: distance between the two eccentric shafts, C1: distance between the centers of two eccentric parts of the above eccentric shafts, e: eccentricity of each of the eccentric gears, P (P=2e): eccentricity of each of the eccentric shafts, a: radius of the minor axis of an ellipse corresponding to each of the above elliptical gears, b: radius of the major axis of the ellipse, R1, R2: variable radius of eccentric ellipse changed according to an angular variation, Q1, Q2: variable angle changed according to a gear rotation, and E: eccentricity. In such a case, the eccentricity E is represented by the following equation.

$$r = a^2 / b$$

$$E = \sqrt{(b^2 - a^2)} \Big/ b = 2e / C = P / C$$

wherein r is a parameter.

The above two gears G1 and G2 can rotatably engage with each other, when R1+R2=C and R1dQ1=R2dQ2. In addition, the second gear G2 can be rotated by the first gear G1, when R1=r/(1−E cos Q1) and R2=r/(1−E cos Q2). Therefore, it is apparent that the two gears G1 and G2 have the same size and configuration and b=C/2. Since $E=\sqrt{(b^2-a^2)}/b=2e/C$, the radius "a"$=\sqrt{[b^2-(b^2E^2)]}=\sqrt{[b^2(1-E^2)]}$.

FIG. 6B shows another method of calculating the radius "a". In accordance with this method, it is apparent that the radiuses R1, R2 are changed in accordance with the variable angle Q1, with the sum total of the two radiuses R1, R2 being not changed regardless of the angle Q1. That is, R1+R2=C=2b. When the angle Q1 is changed, thus positioning the apex of the two radiuses R1, R2 at the minor axis of the ellipse, R1 and R2 are equal to each other. In such a case, 2R1=2b, thus R1=b. Therefore, $a=\sqrt{(R1^2-e^2)}=\sqrt{(R2^2-e^2)}=\sqrt{[(C/2)^2-e^2]}=\sqrt{(b^2-e^2)}$.

When the first gear G1 is rotated at an angle Q1', the rotating angle Q2' of the second gear G2 is calculated as follows.

$$R1'=r/(1-E\cos Q1')$$

$$R2'=r/(1-E\cos Q2')$$

$$Q2'=\cos^{-1}\{1/E[(r/R2')-1]\}$$

When the two gears G1 and G2 are completely rotated at the angles Q1' and Q2' respectively, the distance (C1) between the centers of two eccentric parts of the above eccentric shafts S1 and S2 is represented by the following equation.

$$C1 = \sqrt{[(C - X1 + X2)^2 + (Y1 + Y2)^2]}$$
$$= \sqrt{[(C - P\cos Q1 + P\cos Q2)^2 + (P\sin Q1 + P\sin Q2)^2]}$$

Therefore, it is apparent that the distance C1 is equal to C and is constant regardless of the positions of the two eccentric shafts S1 and S2 with each of the two gears G1 and G2 being rotated at an angle of 360°.

Therefore, when the two cylinder impellers of a twin cylinder runner are connected to the eccentric parts of such eccentric shafts respectively, the runner is smoothly operated without generating any problem.

If two genuine circular eccentric gears are used in place of such elliptical eccentric gears 15 and 18 in the idle gears, the two circular eccentric gears may form an interference at their teeth. Such an interference may be overcome by providing a backlash at the junction between the two eccentric gears. However, when each of the circular eccentric gears has a large eccentricity, the two circular eccentric gears have to be provided with a large backlash, but such a large backlash prevents practical use of the eccentric gears.

In the impeller pump of this invention, the twin cylinder runner is provided with an elastic sealing means for removing any gap from the junction between the runner and the throat of the pump casing 10 when the runner is positioned at its upper or lower dead point. The sealing means is exteriorly provided on each of the cylinder impellers 3 and 4 of the twin cylinder runner at a position around the web 5.

Figure 7:
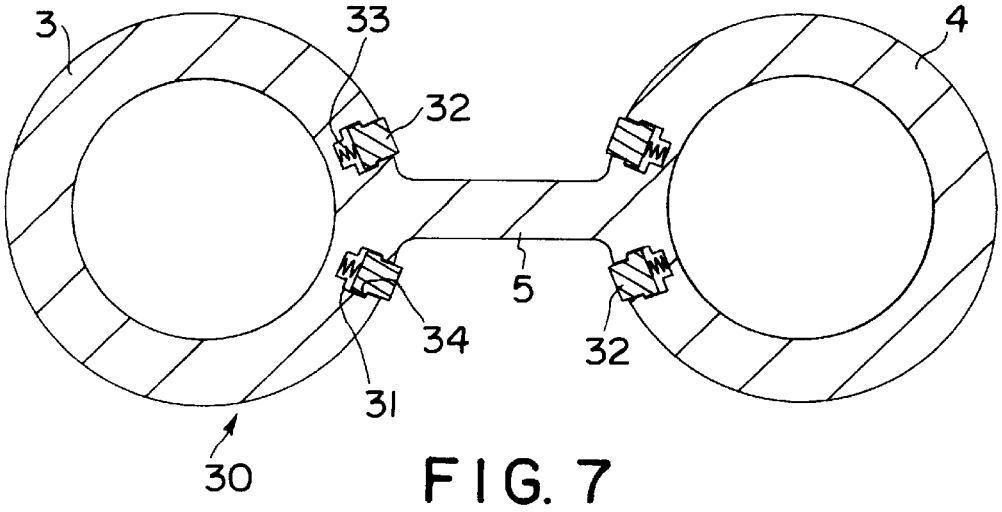
FIG. 7 is a sectional view of a twin cylinder runner in accordance with the primary embodiment of this invention, with four spring-biased sealing blades being set in the runner and being used for removing any gap from the junction between the runner and the throat of a pump casing.

FIG. 7 shows the construction of a sealing means according to the primary embodiment of this invention. In this embodiment, the sealing means includes a spring-biased sealing blade 32.

That is, in the twin cylinder runner made of a metal, a blade groove 31 is axially formed on the outside wall of each of the cylinder impellers 3 and 4 at a position around the web 5. The blade groove 31 is interiorly provided with a step 34 at each side wall. A longitudinal sealing blade 32, having a cross-section corresponding to that of the blade groove 31, is movably received in the groove 31 and is caught by the opposite steps 34, thus being retained in the groove 31. The sealing blade 32 is biased by a spring means 33 at its bottom surface, thereby being normally biased to the outside of the groove 31. The above sealing blade 32 is preferably made of an elastic material such a rubber.

When the twin cylinder runner is positioned at its upper or lower dead point in the pump casing 10 during a pumping operation, two sealing blades 32 of one of the two cylinder impellers 3 and 4 come into close contact with the internal surface of an associated chamber 8, 9 at positions around the throat of the pump casing 10. Therefore, the sealing blades 32 almost completely remove any gap from the junction between the runner and the throat of the pump casing 10 irrespective of a difference between the inner diameter of each chamber 8, 9 and the outer diameter of each cylinder impeller 3, 4 of the twin cylinder runner.

The twin-cylinder impeller pump of this invention thus effectively prevents any pressure loss when the twin cylinder runner is positioned at its upper or lower dead point during a pumping operation.

Figure 8A:
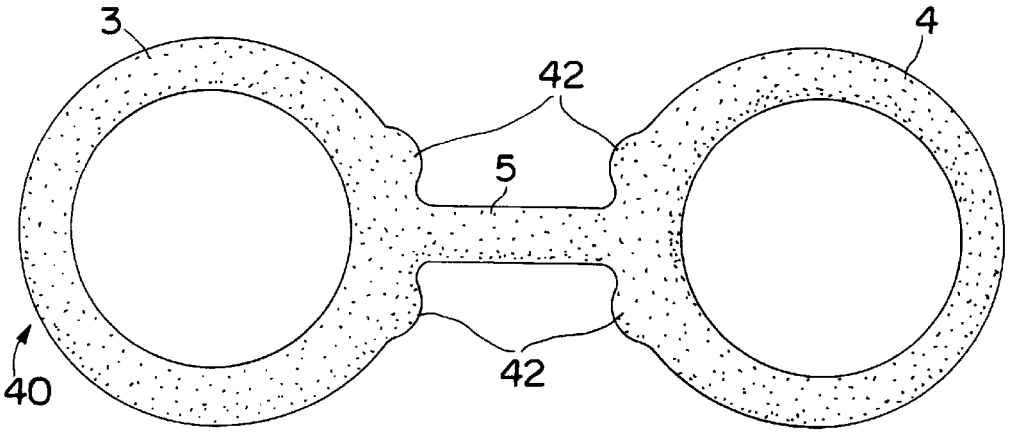
FIGS. 8A and 8B are plan and sectional views of a twin cylinder runner in accordance with another embodiment of this invention, with an elastic cover being coated on the runner and being provided with four sealing ridges for removing any gap from the junction between the runner and the throat of the pump casing.
Figure 8B:
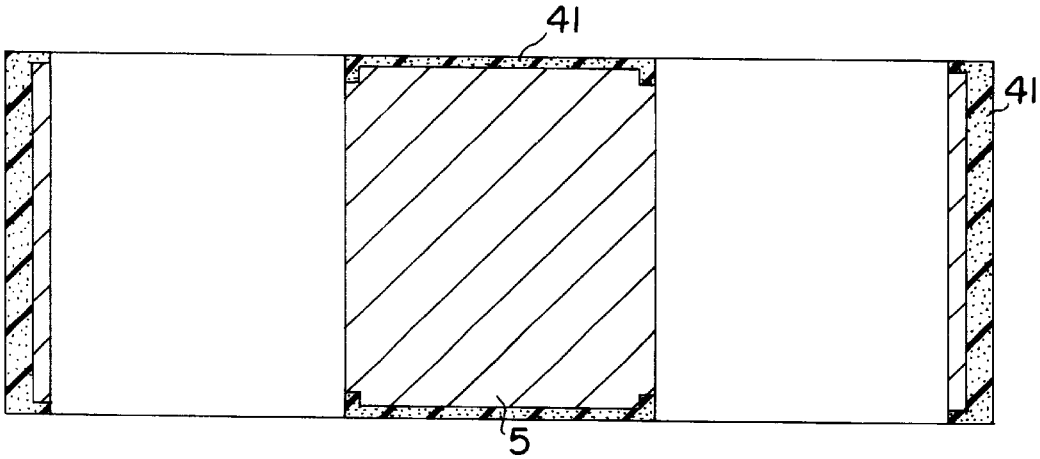

FIGS. 8A and 8B show the construction of a sealing means according to another embodiment of this invention. In this embodiment, the sealing means comprises an elastic cover 41, which is coated on the twin cylinder runner. In order to form such an elastic cover 41, the metal runner is exteriorly coated with an elastic layer such as a natural or synthetic rubber layer having a uniform thickness.

That is, the elastic cover 41, having a uniform thickness, is totally and exteriorly coated on the two cylinder impellers 3 and 4 and the web 5 of the runner. However, the internal surface of each cylinder impeller 3, 4 is free from such an elastic cover 41. A sealing ridge 42 is axially formed on the outside wall of the cover 41 at a position around the web 5.

When the twin cylinder runner, coated with the cover 41, is positioned at its upper or lower dead point in the pump casing 10 during a pumping operation, two sealing ridges 42 of one of the two cylinder impellers 3 and 4 come into elastic contact with the internal surface of an associated chamber 8, 9 at positions around the throat of the pump casing 10. Therefore, the sealing ridges 42 remove any gap from the junction between the runner and the throat of the pump casing 10 and effectively prevent any pressure loss during the pumping operation.

The operational effect of the twin-cylinder impeller pump of this invention will be described hereinbelow.

Figure 9A:
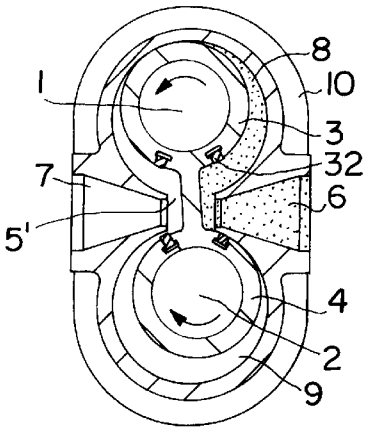
FIGS. 9A to 9F show the operational effect of the impeller pump of this invention.

FIG. 9A shows the impeller pump of this invention in an initial position, in which the twin cylinder runner is positioned at its initial upper dead point. When the pump in the above state is started, the drive and driven shafts 11 and 12 are rotated in opposite directions, thus allowing the first cylinder impeller 3 of the runner to move counterclockwise in the first chamber 8 as shown by the arrow of FIG. 9A while sliding on the internal surface of the chamber 8. In such a case, a back pressure is generated in the right-hand section of the chamber 8 in the drawing, thus sucking liquid into the first chamber 8 through the suction port 6. In the above state, the second cylinder impeller 4 of the runner moves clockwise in the second chamber 9 while sliding on the internal surface of the chamber 9.

Figure 9B:
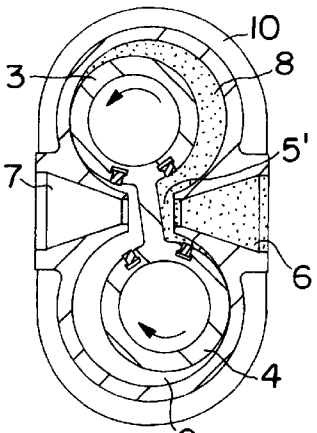
Figure 9C:
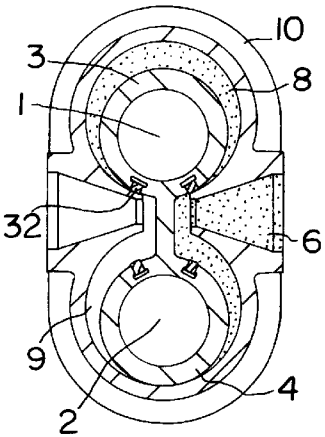

When the two cylinder impellers 3 and 4 of the runner further move in the chambers 8 and 9 in opposite directions, thus reaching the positions of FIG. 9B, the second impeller 4 starts to suck liquid into the chamber 9. When the runner completely reaches its lower dead point as shown in FIG. 9C, the first impeller 3 accomplishes its suction stroke, while the second impeller 4 performs its suction stroke well.

In such a case, the two sealing blades 32 of the first impeller 3 completely remove any gap from the junction between the first impeller 3 and the throat of the pump casing 10 irrespective of a difference between the inner diameter of the first chamber 8 and the outer diameter of the first impeller 3. Therefore, the impeller pump of this invention effectively prevents any pressure loss from the first chamber 8.

Figure 9D:
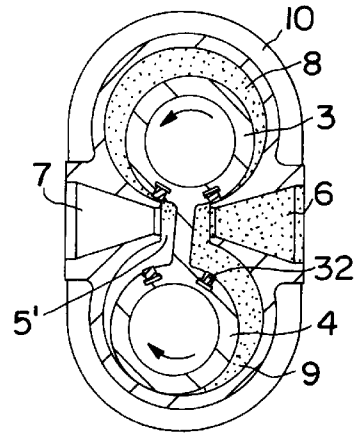

When the runner further moves from its lower dead point and reaches the position of FIG. 9D, the first impeller 3 starts to discharge pressurized liquid from the first chamber 8, while the second impeller 4 continues its suction stroke.

Figure 9E:
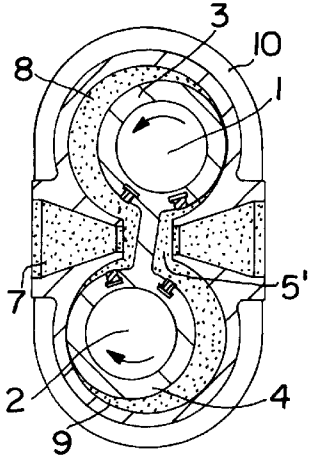
Figure 9F:
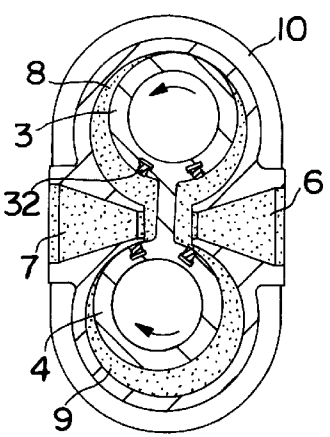

When the runner reaches the position of FIG. 9E, the first impeller 3 continuously discharges pressurized liquid from the chamber 8 and also starts its suction stroke, while the second impeller 4 almost completely accomplishes its suction stroke. Thereafter, the runner further moves and reaches its upper dead point as shown in FIG. 9F. At the position of FIG. 9F, the second impeller 4 almost completely accomplishes its suction stroke, while the first impeller 3 continuously discharges pressurized liquid from the chamber 8 and also performs its suction stroke well prior to reaching the position of FIG. 9A. At the position of FIG. 9A, the second impeller 4 sucks liquid into the chamber 9 and also performs its discharge stroke well, while the first impeller 3 discharges pressurized liquid from the chamber 8 and also performs its suction stroke well. As described above, each of the first and second cylinder impellers 3 and 4 performs its suction and discharge strokes at the same time, with the ratio of the amount of sucked liquid to the amount of discharged liquid of each impeller being alternately changed to be larger or smaller than one in accordance with the position of the runner in the pump casing 10.

That is, when the ratio of the amount of sucked liquid of the first impeller 3 to the amount of discharged liquid of the impeller 3 is larger than one, the ratio of the amount of sucked liquid of the second impeller 4 to the amount of discharged liquid of the impeller 4 is smaller than one. Such a ratio of the amount of liquids is alternately reversed with the twin cylinder runner passing by its upper or lower dead point. Therefore, the runner smoothly sucks and discharges liquid under pressure without changing the amount of sucked or discharged liquid or forming any pulsation during a pumping operation. In addition, the sealing means of the runner almost completely removes any gap from the junction between the runner and the throat of the pump casing when the runner is positioned at its upper or lower dead point. Therefore, the sealing means effectively prevents any pressure loss from the chambers and allows the runner to more effectively suck and discharge liquid.

Industrial Applicability

As described above, the present invention provides an improved twin-cylinder impeller pump. In the above impeller pump, the twin cylinder runner is provided with an elastic sealing means for removing any gap from the junction between the runner and the throat of the pump casing with the runner being positioned at its upper or lower dead point. In the transmission gear mechanism of the above impeller pump, the motor-operated drive shaft does not directly engage with a driven shaft, but indirectly engages with the driven shaft through two idle gears. In each of the idle gears, both a circular concentric gear and an elliptical eccentric gear are commonly mounted to a shaft, thus forming a twin gear. The two elliptical eccentric gears engage with each other, while the two circular concentric gears engage with the drive and driven gears respectively. Due to such idle gears, the transmission gear mechanism is free from any excessive backlash, thus effectively reducing operational noises and vibrations during a pumping operation. The two idle gears also allows small-sized gears to be used as the drive and driven gears, thus conserving power and improving operational efficiency of the impeller pump.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A twin-cylinder impeller pump, comprising:

a pump casing having two cylindrical chambers and suction and discharge ports, said chambers being symmetrically formed in said casing, with an intermediate throat being formed between the two chambers, and also communicating with each other through an opening formed at said throat, and said suction and discharge ports being formed at opposite side walls of said throat;

a twin cylinder runner movably received in said pump casing and comprised of two cylinder impellers integrated into a single structure by a web, said two cylinder impellers being eccentrically received in the two chambers of the casing with the web passing through the opening of the throat of the casing, thus being slidably inscribed with the chambers respectively; and a gear mechanism adapted for transmitting a rotating force to said twin cylinder runner, thus allowing the two impellers of the runner to move in the chambers in opposite directions, said gear mechanism comprising:

drive and driven circular gears arranged to be spaced apart from each other and fixedly and concentrically fitted over eccentric shafts respectively, each of said eccentric shafts having an eccentric part at one end thereof and being rotatably connected to each of said two cylinder impellers at said eccentric part; and two idle gears arranged between said drive and driven gears, thus allowing the drive and driven gears to be rotated in opposite directions, each of said idle gears being comprised of a circular concentric gear and an elliptical eccentric gear commonly connected to one shaft and integrated into a twin gear, the two concentric gears engaging with the drive and driven gears respectively and the two eccentric gears engaging with each other, thus transmitting the rotating force of the drive gear to the driven gear and allowing the drive and driven gears to be rotated in opposite directions, each of said elliptical eccentric gears having a major axis in an eccentric direction and a minor axis in another direction perpendicular to the eccentric direction.

2. The twin-cylinder impeller pump according to claim 1, wherein said twin cylinder runner is provided with an elastic sealing means for removing any gap from the junction between said runner and said throat of the pump casing with the runner being positioned at its upper or lower dead point.

3. The twin-cylinder impeller pump according to claim 2, wherein said sealing means comprises:

a blade groove axially formed on the outside wall of each of said cylinder impellers at a position around said web, said blade groove being interiorly provided with a step at each side wall thereof; and a longitudinal sealing blade movably received in said blade groove and caught by the step of said groove, said sealing blade being biased by a spring at its bottom surface, thus being normally biased to the outside of said groove.

4. The twin-cylinder impeller pump according to claim 2, wherein said sealing means comprises:

an elastic cover coated on said twin cylinder runner, with a sealing ridge being axially formed on the outside wall of said cover at a position around said web.

5. The twin-cylinder impeller pump according to claim 1, wherein the width of each of said suction and discharge ports is smaller than the maximum gap between the outer surface of each of said cylinder impellers and the inner surface of an associated chamber.

* * * * *